US006432903B1

(12) United States Patent
Dudley

(10) Patent No.: US 6,432,903 B1
(45) Date of Patent: Aug. 13, 2002

(54) AIR CONDITIONING SYSTEM FLUSH SOLVENT

(75) Inventor: Newton Howard Dudley, Blum, TX (US)

(73) Assignee: Technical Chemical Company, Cleburne, TX (US)

( * ) Notice: Subject to any disclaimer, the term of this patent is extended or adjusted under 35 U.S.C. 154(b) by 7 days.

(21) Appl. No.: 09/678,043

(22) Filed: Oct. 3, 2000

(51) Int. Cl.[7] ..... C11D 3/44

(52) U.S. Cl. ..... 510/407; 510/411; 134/111; 134/22.1

(58) Field of Search ..... 134/7, 111, 22.1; 252/364; 510/407, 411, 505, 201, 412; 137/899.4; 62/84, 85; 96/189; 8/142

(56) References Cited

U.S. PATENT DOCUMENTS

| | | | | |
|---|---|---|---|---|
| 1,636,512 | A | | 7/1927 | Hilger |
| 2,249,622 | A | | 7/1941 | Schlumbohm |
| 2,321,964 | A | | 6/1943 | Zieber |
| 2,475,218 | A | | 7/1949 | Campbell |
| 3,665,053 | A | * | 5/1972 | Mizutani et al. |
| 3,908,650 | A | * | 9/1975 | Dunshee et al. |
| 4,167,102 | A | | 9/1979 | Willitts |
| 4,285,206 | A | | 8/1981 | Koser |
| 4,304,102 | A | | 12/1981 | Gray |
| 4,768,347 | A | | 9/1988 | Manz et al. |
| 4,805,416 | A | | 2/1989 | Manz et al. |
| 4,809,520 | A | | 3/1989 | Manz et al. |
| 4,982,578 | A | | 1/1991 | Heffner et al. |
| 5,005,375 | A | | 4/1991 | Manz et al. |
| 5,078,756 | A | | 1/1992 | Major et al. |
| 5,243,831 | A | | 9/1993 | Major et al. |

* cited by examiner

*Primary Examiner*—Gregory E. Webb
(74) *Attorney, Agent, or Firm*—Marlin R. Smith, Esq.; J. Richard Konneker, Esq.; Konneker & Smith, P.C.

(57) ABSTRACT

An air conditioning system flush solvent and associated method of flushing air conditioning systems provides enhanced removal of moisture in air conditioning systems. In a described embodiment, an air conditioning system flush solvent consists essentially of a proportion of heptane less than or equal to approximately 70% and a proportion of isopropyl alcohol greater than or equal to approximately 29%.

15 Claims, No Drawings

AIR CONDITIONING SYSTEM FLUSH SOLVENT

BACKGROUND

The present invention relates generally to solvents used for flushing air conditioning systems and, in an embodiment described herein, more particularly provides an air conditioning system flush solvent having enhanced effectiveness.

There are many circumstances in which an air conditioning system may be flushed with a solvent. For example, after failure of a component, such as a compressor, the air conditioning system may be flushed to remove debris from the system. The retrofitting of R-12 systems to use R-134a refrigerant generally requires the removal of mineral oil from the system, since mineral oil is used as a lubricant in R-12 systems, but is incompatible with R-134a. Additionally, the removal of excess oil and sludge in any system may be accomplished by flushing the air conditioning system with an appropriate solvent.

Another important benefit may be achieved by flushing an air conditioning system with a solvent. That benefit is the removal of moisture from the system. As is well known, moisture in an air conditioning system reduces the efficiency of the system.

Unfortunately, past air conditioning flush solvents have not been formulated specifically for enhanced effectiveness in removing moisture from air conditioning systems. For example, one known air conditioning solvent includes almost 75% heptane, approximately 5% fragrance and less than 25% isopropyl alcohol.

Therefore, it may be seen that it would be quite desirable to provide an air conditioning flush solvent which is particularly effective in removing moisture from air conditioning systems. It is an object of the present invention to provide such an air conditioning flush solvent.

SUMMARY

In carrying out the principles of the present invention, in accordance with an embodiment thereof, an air conditioning flush solvent is provided which has enhanced effectiveness in removing moisture from air conditioning systems. Associated methods of flushing air conditioning systems are also provided.

In one aspect of the invention, an air conditioning flush solvent is provided which comprises 69.5% heptane, 29.5% isopropyl alcohol and 1% fragrance. An increased proportion of isopropyl alcohol enhances the effectiveness of the flush solvent in removing moisture from an air conditioning system.

In another aspect of the invention, an air conditioning flush solvent is provided which consists essentially of 60–70% heptane and 29–40% isopropyl alcohol. The flush solvent may also include up to 1% fragrance.

These and other features, advantages, benefits and objects of the present invention will become apparent to one of ordinary skill in the art upon careful consideration of the detailed description of a representative embodiment of the invention hereinbelow.

DETAILED DESCRIPTION

All proportions described herein are by volume percent.

The inventor has discovered a formulation for an air conditioning flush solvent which accomplishes the traditional objectives of removing debris, oil and sludge from an air conditioning system, while having particular effectiveness in removing moisture from the system. Preferably, the formulation is 69.5% heptane, 29.5% isopropyl alcohol and 1% fragrance, although these proportions may be varied somewhat without departing from the principles of the present invention.

For example, the proportion of heptane may be from approximately 60% to approximately 70%. The proportion of isopropyl alcohol may be from approximately 29% to approximately 40%. The proportion of fragrance may be from 0% to approximately 1%.

For achieving the above objectives of the invention, the inventor prefers that the air conditioning flush solvent have a proportion of heptane less than or equal to 70% and a proportion of isopropyl alcohol greater than or equal to 29%.

The inventor has found that the above-described air conditioning flush solvent is useful in flushing air conditioning systems, is compatible with commonly used refrigerants and has enhanced effectiveness in removing moisture from air conditioning systems. In practice, the air conditioning system flush solvent is forced through the air conditioning system, or individual components thereof. Debris, oil, sludge and moisture are removed from the air conditioning system by the flush solvent.

WORKING EXAMPLE

An airconditioning system flush solvent is prepared by mixing 60–70% heptane with 29–40% isopropyl alcohol and up to 1% fragrance. Preferably, the mixture comprises 69.5% heptane, 29.5% isopropyl alcohol and 1% fragrance. The flush solvent is then forced through an air conditioning system, or individual components thereof, to thereby remove debris, oil, sludge and moisture from the system.

Of course, a person skilled in the art would, upon a careful consideration of the above description of an embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. An air conditioning system flush solvent, comprising:

approximately 60% to approximately 70% heptane;

up to approximately 1% fragrance; and approximately 29% to approximately 40% isopropyl alcohol.

2. The air conditioning system flush solvent according to claim 1, wherein the proportion of heptane is 69.5%.

3. The air conditioning system flush solvent according to claim 1, wherein the proportion of isopropyl alcohol is 29.5%.

4. The air conditioning system flush solvent according to claim 1, wherein the proportion of heptane is less than or equal to 70%.

5. The air conditioning system flush solvent according to claim 1, wherein the proportion of isopropyl alcohol is greater than or equal to 29%.

6. An air conditioning system flush solvent, consisting essentially of:

heptane in proportion less than or equal to approximately 70%;

fragrance in proportion up to approximately 1%; and isopropyl alcohol in proportion greater than or equal to approximately 29%.

7. The air conditioning system flush solvent according to claim 6, wherein the proportion of heptane is 60% to 70%.

8. The air conditioning system flush solvent according to claim 6, wherein the proportion of heptane is 69.5%.

9. The air conditioning system flush solvent according to claim 6, wherein the proportion of isopropyl alcohol is 29% to 40%.

10. The air conditioning system flush solvent according to claim 6, wherein the proportion of isopropyl alcohol is 29.5%.

11. A method of flushing an air conditioning system, the method comprising the steps of:

forcing an air conditioning system flush solvent through the air conditioning system; and removing moisture from the air conditioning system with the flush solvent consisting essentially of heptane in proportion less than or equal to approximately 70%, fragrance in proportion up to approximately 1%, and isopropyl alcohol in proportion greater than or equal to approximately 29%.

12. The method according to claim 11, wherein in the moisture removing step, the proportion of heptane is 60% to 70%.

13. The method according to claim 11, wherein in the moisture removing step, the proportion of heptane is 69.5%.

14. The method according to claim 11, wherein in the moisture removing step, the proportion of isopropyl alcohol is 29% to 40%.

15. The method according to claim 11, wherein in the moisture removing step, the proportion of isopropyl alcohol is 29.5%.

* * * * *